US009636717B2

(12) United States Patent
Flury et al.

(10) Patent No.: US 9,636,717 B2
(45) Date of Patent: May 2, 2017

(54) DEVICE AND METHOD FOR CLEANING COMBUSTION DEVICES

(71) Applicant: Bang & Clean GmbH, Remetschwil (CH)

(72) Inventors: Rainer Flury, Schliern bei Koniz (CH); Markus Bürgin, Remetschwill (CH)

(73) Assignee: BANG & CLEAN GMBH, Othmarsingen (CH)

( * ) Notice: Subject to any disclaimer, the term of this patent is extended or adjusted under 35 U.S.C. 154(b) by 150 days.

(21) Appl. No.: 14/653,133

(22) PCT Filed: Dec. 17, 2013

(86) PCT No.: PCT/CH2013/000225
§ 371 (c)(1),
(2) Date: Jun. 17, 2015

(87) PCT Pub. No.: WO2014/094190
PCT Pub. Date: Jun. 26, 2014

(65) Prior Publication Data

US 2015/0343501 A1 Dec. 3, 2015

(30) Foreign Application Priority Data

Dec. 20, 2012 (CH) ..... 2911/12

(51) Int. Cl.
*B08B 7/00* (2006.01)
*B08B 9/08* (2006.01)
(Continued)

(52) U.S. Cl.
CPC ..... *B08B 7/0007* (2013.01); *B08B 9/08* (2013.01); *F23J 3/02* (2013.01); *F27D 25/006* (2013.01); *F28G 7/005* (2013.01)

(58) Field of Classification Search
CPC .... B08B 7/007; B08B 9/08; F23J 3/02; F27D 25/006; F28G 7/005
See application file for complete search history.

(56) References Cited

U.S. PATENT DOCUMENTS

| | | | | |
|---|---|---|---|---|
| 5,230,306 | A | 7/1993 | Barringer et al. | |
| 6,431,073 | B1 * | 8/2002 | Zilka | B08B 7/0007 102/302 |
| 6,935,281 | B2 * | 8/2005 | Ruegg | F27D 25/006 122/379 |

FOREIGN PATENT DOCUMENTS

| | | |
|---|---|---|
| DE | 42 24 779 | 2/1993 |
| EP | 1 362 213 | 11/2003 |
| EP | 1 987 895 | 11/2008 |

* cited by examiner

*Primary Examiner* — Saeed T Chaudhry
(74) *Attorney, Agent, or Firm* — Rankin, Hill & Clark, LLP

(57) ABSTRACT

A cleaning device for removing deposits in receptacles by way of blasting technology includes a cleaning lance with a grip-side and with a cleaning-side end section, on which a flexible container envelope forming a receiving space can be attached. The cleaning lance includes a feed tube with a container connection device that is arranged on the cleaning-side end section and is for feeding the explosive mixture or its starting components, to the container envelope, as well as a protective tube with a receiving space for a container envelope for the propose of shielding the container envelope to the outside. The protective tube is displaceably arranged along the longitudinal axis of the cleaning lance relative to the feed tube from a first position, in which the container envelope is shielded by the protective tube, into a second position in which the container envelope projects out through the protective tube.

15 Claims, 12 Drawing Sheets

(51) Int. Cl.

| | |
|---|---|
| ***F23J 3/02*** | (2006.01) |
| ***F27D 25/00*** | (2010.01) |
| *F28G 7/00* | (2006.01) |

E
350
351
341
340
342
345
344
305b
304
312
348
326

DEVICE AND METHOD FOR CLEANING COMBUSTION DEVICES

BACKGROUND OF THE INVENTION

Field of the Invention

The invention lies in the field of interior cleaning of receptacles and relates to a device and to a method for removing deposits in the interior of receptacles by way of blasting technology. In particular, the invention relates to a device and to a method for cleaning dirty and slagged receptacles with caking on their inner walls, in particular of incineration installations, by way of blasting technology. Such a method is also called blasting cleaning.

Description of Related Art

Heating surfaces, e.g. of waste incineration plants or coal-fired boilers are generally exposed to large contamination or fouling. This fouling has inorganic compositions and typically arises due to deposits of ash particles on the wall. Coatings in the region of high flue gas temperatures are mostly very hard, since they remain stuck to the wall in either molten form or are melted on the wall or are stuck together by way of substances melting or condensing at a lower temperature, when solidifying on the colder boiler wall. Such coatings are very difficult to remove and are inadequately removed by way of known cleaning methods. This leads to the boiler having to be being periodically taken out of service, cooled and cleaned manually or by way of sand blasting. For this, the construction of a scaffold in the furnace or kiln is often necessary, since such boilers usually have extremely large dimensions. This moreover requires an operational interruption of several days or weeks and is extremely unpleasant and unhealthy for the cleaning personnel due to the large occurrence of dust and dirt. One consequence which mostly inherently occurs with an operational interruption of an installation is damage to the container materials themselves as a result of the large temperature changes. The installation standstill costs due to the production or income losses are an important cost factor, additionally to the cleaning and repair costs.

Conventional cleaning methods that are used when the installations are shut down are for example boiler beating, as well as the use of steam jet blasters, water jet blasters/soot blasters as well as sand blasting.

Moreover, a cleaning method is known, with which the cooled-down or the hot boiler that is in operation is cleaned by way of introducing and igniting explosive bodies. The disadvantage with this method is the necessity for explosives. Apart from the high costs for the explosive material, a huge expense with regard to safety must be met, for example with the storage of the explosive, in order to avoid accidents and theft. The introduction of explosive material into a hot receptacle moreover necessitates an absolutely reliable and efficient cooling system, in order to prevent a premature detonation of the explosive.

A further cleaning method is known from EP 1 362 213 B1, which likewise makes use of means for the production of an explosion. Instead of explosive, according to this method however, a container envelope that is inflatable with an explosive gas mixture is attached onto the end of a cleaning lance. The cleaning lance then together with the empty container envelope is introduced into the boiler space and is positioned in the proximity of the location to be cleaned. Subsequently, the container envelope is inflated with an explosive gas mixture. An explosion is produced by way of igniting the gas mixture in the container envelope, and the shock waves of this explosion lead to the detachment of fouling on the boiler walls. The container envelope is thereby shredded and combusted by way of the explosion. It therefore represents a consumable material.

This method and the associated device compared to the blasting technology with explosive and which is mentioned above, has the advantage that the method is favourable with regard to operation. Thus, for example, the starting components of a gas mixture, which comprises oxygen and a gas of the group of combustible hydrocarbons, is inexpensive in procurement in comparison to explosives. Moreover, the procurement and handling of the mentioned gases, in contrast to explosives requires no special permits or qualifications, so that anyone with a suitable training can carry out the method. Moreover, it is also advantageous that the starting components are fed to the cleaning lance via separate feed conduits or are even introduced separately into the receiving space of the container envelope, and the dangerous explosive gas mixture therefore is not created in the cleaning lance or even in the receiving space of the container envelope already placed in the boiler space, until shortly before triggering the explosion. In comparison to explosives, the handling of the individual components of the gas mixture is indeed far less dangerous, since these individually at the most are combustible, but not explosive.

The container envelope receiving the explosive gas mixture for example includes layers of paper and/or plastic.

The flexible container envelopes are designed in a relatively thin and combustible manner and are therefore extremely sensitive with regard to fire and heat. It is ensured in this manner that the container envelope combusts due to the triggered explosion or subsequently to this, in order, where possible, or leave no residues in the boiler space. The combustible design of the container envelope, however, has the disadvantage that this can be damaged or even destroyed even before its filling or before the ignition of the explosion on introduction into the boiler space, on account of the prevailing heat as well as due to the combustion processes.

Inadvertent contact of the container envelope with the hot boiler wall can also lead to damage of this container envelope, apart from the heat and the hot combustion gases in the boiler space.

The container envelopes are wetted with a cooling fluid, in particular water, before or during introduction into the boiler space, in order to prevent this undesirable effect.

This measure, however, is not always sufficient, in order to prevent prior damage or destruction of the container envelope. Despite the wetting of the container envelope, the problem mentioned above particularly exists if the introduction of the container envelope into the boiler space and the placing of this container envelope at the correct location take up a significant amount of time or the container envelope comes into contact with the hot boiler wall, or hot installations such as tube bundles, in the boiler space.

SUMMARY OF THE INVENTION

It is therefore object of the present invention, to modify the above-mentioned cleaning device and the associated method, such that the container envelope where possible remains intact in the boiler space until the triggering of the explosion subsequent to the filling of this container envelope. The operation of the cleaning device should moreover be simple and further ensure an increased safety.

The cleaning device according to the invention thus includes a cleaning lance with a grip-side and a cleaning-side end section. A flexible container envelope forming a receiving space can be attached on the cleaning-side end section. The cleaning lance moreover includes a feed channel with a container connection device arranged on the cleaning-side end section. The feed channel serves for feeding the explosive mixture or its starting components, to the container envelope. The feed channel runs along the longitudinal axis of the cleaning lance and preferably has a closed channel cross section. The feed channel is preferably designed as a tubular conduit body, in particular as a feed tube (feed pipe).

The container connection device can be designed as a connection piece, onto which the container envelope is fastened. The connection piece can be designed as a separate component or as an integral part of the feed tube.

The container connection device can also comprise a filling tube (filling pipe) which is arranged at the cleaning-side end section and is with a plurality of outlet openings for filling the container envelope with the explosive mixture, the outlet openings being arranged along the longitudinal axis on the periphery of the filling tube. The filling tube can be designed as a separate component or as an integral part of a feed tube. The diameter of the filling tube can be smaller than the diameter of the feed tube.

The cleaning device preferably includes a supply device for providing or preparing and/or feeding the explosive gas mixture or its components. The explosive mixture or its components are fed via feed conduits and the associated connections on the cleaning lance, into the feed channel or the feed tube of the cleaning lance.

The cleaning lance moreover preferably also includes an ignition device, by way of which the explosive mixture in the feed channel or in the container envelope can be ignited.

The cleaning device preferably moreover also includes a control device for the control of the filling procedure of the container envelope as well as for the control of the ignition of the explosive mixture. In the case of the provision of a cooling device, then the control device then preferably also serves for the control of the coolant feed. A subsequently described end-switch device can moreover also be connected to the control device.

The cleaning lance moreover includes a protective tube with a receiving space for a container envelope, for the purpose of shielding the container envelope that is attached on the container connection device.

The term "protective tube" is generally to be understood as a tubular or tube-like shielding body with an open or closed cross section and that includes an opening for ejecting, which is to say for pushing out, the container envelope. The opening is preferably a face-side opening that is arranged at the end of the protective tube, which is opposite to the grip-side end section. The protective tube is, for example, manufactured of metal, in particular of steel.

The cleaning method is based on the concept of bringing an explosive mixture of gaseous, liquid and/or powder-like or pulverous components, which are brought into the receiving space the flexible container envelope, together with the container envelope, into the proximity of a location to be cleaned in the inside of a receptacle, in order to subsequently bring the mixture to explode amid the destruction of the container envelope.

The explosive mixture preferably includes at least one gaseous component and in particular is preferably completely gaseous, in particular in the explosive condition. For this, the explosive mixture is preferably exclusively created from components in gaseous form or which rapidly evaporate. The flexible container envelope is swelled or inflated due to the inflowing gas, amid the expansion of the receiving space. The explosive mixture preferably includes a fuel such as an oxidant such as, for example, gaseous oxygen or an oxygen-containing gas. The fuel can be liquid or gaseous, such as, for example, a hydrocarbon compound such as acetylene, ethylene, methane, ethane, propane, petrol, oil etc.

The explosive mixture can be brought into the container envelope or fed to the cleaning lance already as a mixture. Preferably, the components or at least individual components of the mixture are fed individually to the cleaning lance, in particular via separate feed conduits and are mixed with one another in the feed channel into the explosive [end] mixture.

The impact of the explosion and the surface, e.g. a container wall or tube wall, which is brought into oscillation by the shock waves, effect the blasting-away of the wall caking and slag and thus the cleaning of the surface.

The strength of the explosion that is necessary for a cleaning and thus the quantity of the applied starting components of the mixture is directed to the type of fouling and to the size and type of the fouled receptacle. The metering and strength of the explosion can and are preferably selected such that no damage to the installations occurs. The possibility of the optimal metering of the applied substances on the one hand reduces the cleaning costs and on the other hand the danger and damage risk to the installation and persons.

The flexible container envelope thus also forms a receiving vessel for the explosive mixture and permits the secure positioning of the mixture at the location to be cleaned. Moreover, the container envelope prevents a dilution of the explosive mixture with the surrounding air. Moreover, the container envelope can also serve for cooling the explosive mixture, in order to prevent the mixture being ignited already prematurely in the hot boiler space.

In accordance with the present invention, the feed channel is displaceably arranged along the longitudinal axis of the cleaning lance, relative to the protective tube, from a first position, in which the container envelope is shielded with respect to the environment by the protective tube, into a second position, in which the container envelope projects out of the shielding through protective tube.

The feed channel preferably runs in the longitudinal direction of the cleaning lance from the grip-side end section to the cleaning-side end section. The cleaning lance includes means such as conduit connections, for feeding the explosive mixture or components thereof to the feed channel. These are preferably arranged on the grip-side end section of the cleaning lance.

The protective tube can have a length of 50 to 200 cm, in particular of 100 to 200 cm. The outer diameter of the protective tube can, for example, be 60 to 200 mm, in particular about 100 mm.

The length of the cleaning lance is preferably several meters, for example, 5 to 10 m. However, it can also be more than 10 m.

According to a particular further development of the invention, the protective tube or a guide tube, which is connected to the protective tube, is designed as a displacement tube or sliding tube which is displaceably, in particular slidingly displaceably led on the cleaning lance along the longitudinal axis L relative to the feed channel.

The protective tube or the tube connected to the protective tube can be displaceably, in particularly slidingly displaceably guided along the longitudinal axis of the cleaning lance, for example on the outer periphery of the feed channel designed as a feed tube or on an outer tube enveloping the feed channel.

A sliding guide/guiding is usefully provided for the purpose of the sliding diplaceability of the mentioned components. The sliding guide can be designed, for example, by a gland seal, which seals the components moved relative to one another, against one another.

According to a further development of the invention, the feed channel is enveloped by an outer tube, wherein preferably a channel, such as a cooling channel, in particular an annular channel, into which a coolant can be fed, is formed between the feed channel, in particular a feed tube, and the outer tube. The coolant, amongst other things, serves for cooling the feed tube.

The cooling channel is preferably fed with coolant at the grip-side end section via suitable feed conduits. The cooling channel at the cleaning side comprises an axial exit opening for the coolant into the protective tube, via which opening the protective tube as well as the container envelope can be subjected to the coolant.

The outer tube and/or the feed tube are preferably manufactured of a metal, in particular of steel.

According to a first embodiment variant, the cleaning lance includesan outer tube which envelops the feed channel, in particular the feed channel formed as a feed tube. The feed tube in this case is formed as an inner tube. The protective tube or the guide tube, which is connected to the protective tube, is guided in a sliding manner on the outer periphery of the outer tube relative to this outer tube.

The protective tube or the guide tube has, for example, e.g. an inner diameter which corresponds to the outer diameter of the outer tube or is larger than this.

This embodiment has the advantage that the container envelope can continue to be able to be cooled with coolant exiting at the face side at the annular coolant channel, even after the retraction of the protective tube relative to the feed tube.

According to a further development of the first embodiment, the protective tube is connected to a guide tube, which is arranged towards the grip-side end section. The guide tube is designed as a sliding tube. This together with the protective tube is displaceably guided on the cleaning lance relative to the feed channel along the longitudinal axis. For this, the guide tube is guided in a slidingly displaceable manner on the outer tube, always to be understood as a relative movement.

The protective tube or the guide tube can be slidingly displaceably guided on the outer tube via a sleeve with a seal gland.

According to a second embodiment variant of the invention, the outer tube is designed in a multi-part manner and includes at least two outer tube sections. The at least two outer tube sections are arranged displaceable to one another along the longitudinal axis.

The one outer tube section, preferably a first outer tube section, for this has an outer diameter that corresponds to or is smaller than the inner diameter of the other outer tube section, preferably of a second outer tube section. The one outer tube section is guided with a tube end section in the other outer tube section and can be extended out of this and retracted into it. The two outer tube sections in particular can be telescopically displaced to one another.

The arrangement can also be designed the other way round, with a first outer tube section having a diameter which corresponds to or is larger than the outer diameter of the second outer tube section. The second outer tube section is guided with a tube end section in the first outer tube section and can be extended out of this and retracted into it.

A first outer tube section is preferably connected to the grip-side end section of the cleaning lance. A second outer tube section is preferably connected to the protective tube.

The first outer tube section is preferably connected to the feed tube or coupled to it, in a fixed manner. In other words, the first outer tube section is not displaceable with respect to the feed tube.

The second outer tube section is also displaceable with respect to the feed tube due to its displaceability with respect to the first outer tube section. The second outer tube section is preferably slidingly guided along the outer periphery of the feed tube.

The feed tube and with this, a container connection device, can be displaced relative to the protective tube and in particular can be extended out of this, due to a relative displacement between the first and the second outer tube section.

The first outer tube section can be centered with respect to the feed tube via centering elements which are positioned radially along the outer periphery of the feed tube. The centering elements can be attached on the outer periphery of the feed channel and/or on the inner periphery of the first outer tube section. The first outer tube section is preferably slidingly displaceably guided along the outer periphery of the feed tube via the centring elements.

Abutment elements, which in cooperation with the centring elements form an abutment can be moreover be attached on the outer periphery of the feed tube and/or the inner periphery of the second outer tube section. The abutment should limit the axial displacement of the outer tube sections to one another. A complete pulling-apart of the outer tube sections is to be prevented by way of this.

The two outer tube sections can be displaceably guided to one another in a sliding manner via a sleeve with a gland seal.

An insertion limitation element can be arranged on the protective tube, on the guide tube or on the outer tube of the mentioned embodiment variants. The insertion limitation element serves as an abutment on inserting the cleaning lance into the interior of the receptacle which is to be cleaned, and after a defined insertion stretch (distance) abuts on a component on the receptacle at the outside. The insertion limitation element has the effect that the protective tube cannot be inserted further into the interior of the receptacle, whereas the feed channel or the feed tube can be inserted further into the interior of the receptacle due to the relative displaceability with respect to the protective tube. The insertion limitation element, for example, can be a flange or an adjustment ring.

The cleaning device can also include an insertion component which, for example, can be inserted into a through-opening of the container wall or be directly or indirectly attached at the outside on the container wall via a through-opening. The insertion component can include a guide tube section for guiding the cleaning lance, for example, the lance tube, the outer tube and/or the protective tube.

The cleaning lance for carrying out the cleaning method is inserted through the through-opening of the insertion component into the interior of the receptacle. The cleaning lance is led and supported by the guide tube section during the introduction into the interior as well as during the cleaning procedure after the insertion. On account of this, the user does not need to carry the complete weight of the cleaning lance when carrying out the method.

The invention also relates to a method for removing deposits in receptacles by way of blasting (explosion) technology while using the cleaning device described above. The method includes the following steps:

a. attaching a container envelope on the container connection device at the cleaning-side end section of the cleaning lance;
b. displacing the protective tube relative to the feed channel whilst receiving the container envelope in the receiving space of the protective tube;
c. inserting the cleaning lance with its cleaning-side end section into the interior of the receptacle to be cleaned;
d. displacing the protective tube relative to the feed channel whist releasing the container envelope;
e. filling the container envelope with an explosive mixture or with its components;
f. igniting the explosive mixture in the container envelope.

The protective tube is preferably pushed over the container connection device for receiving the container envelope in the receiving space of the protective tube. The protective tube is preferably displaced towards the grip-side end section for releasing the container envelope.

The cleaning lance, subsequent to the executed cleaning explosion, is again pulled out of the interior of the receptacle to be cleaned. The protective tube is left in its current, retracted position, for attaching a further container envelope for the purpose carrying out a further cleaning cycle. A new cleaning cycle as described above can be initiated with the attachment of a further container envelope.

The feed tube or the outer tube can basically be displaced along the longitudinal axis L relative to the protective tube or the guide tube in a manual or automated manner. The relative displacement of the feed tube or of the outer tube with respect to the protective tube or the guide tube can be effected via suitable actuation means.

According to a further development of the invention, the insertion component can be part of the actuation means. These actuation means can moreover envisage a pull cable device, with fastening means on the lance tube or outer tube, for fastening at least one cable and with deflection means on the insertion component for deflecting the at least one cable.

According to a further development of the invention, the cleaning lance comprises an end-switch device which with the telescopic sliding-together of the two tube bodies, for example, of two outer tube sections, triggers a control signal on reaching a certain amount of displacement, in particular on displacing the two tube bodies together up to an end position. The control signal can, for example, be a release signal which only in the first place permits the filling of the container envelope and/or the ignition of the explosive mixture.

The end-switch device can, for example, include a first contact means attached on the first tube body and a second contact mans attached on the second tube body, said contact means coming into contact with one another and thus triggering a control signal, in particular with the telescopic pushing-together of the two tube bodies on reaching a defined displacement amount.

The container envelope can be stowed in the protective tube for a comparatively long time thanks to the cleaning device according to the invention. The container envelope does not need to be pushed out (ejected) of the protective tube until at the location of the cleaning. The risk of damage to the container envelope due to the harsh conditions in the boiler space is significantly reduced on account of this.

The operational safety is moreover also increased on account of the operation of the cleaning device according to the invention through comparatively small openings in the boiler wall. The operation of the cleaning device is also simplified since the cleaning lance of the cleaning device can moreover be led through the comparatively small opening in the boiler wall or in the insertion component and can be held in a fixed position on abutting the insertion limitation element. The operation of the cleaning device in particle also requires fewer personnel.

The cleaning device according to the invention is therefore particularly suitable for frequent cleaning, since expense with regard to personnel is reduced with a simultaneously increased operational reliability and operational friendliness. The frequent cleaning moreover has the advantage that the contamination in the boiler is lower per cleaning cycle and is moreover less stubborn and therefore easier to overcome. The cleaning costs with the cleaning device according to the invention, even with higher cleaning cycles are therefore lower than with less cleaning cycles with a conventional cleaning device.

BRIEF DESCRIPTION OF THE DRAWINGS

The subject-matter of the invention is hereinafter explained in more detail by way of preferred embodiment examples which are represented in the accompanying drawings. There are shown in.

DETAILED DESCRIPTION OF THE PREFERRED EMBODIMENT

Figure 1A:
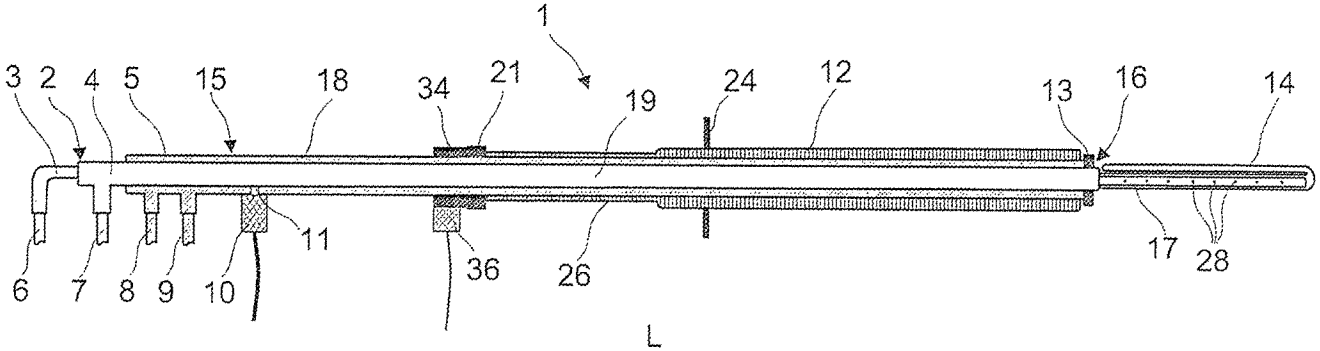
FIG. 1*a-d*: a first embodiment of a cleaning device according to the invention.
Figure 1B:
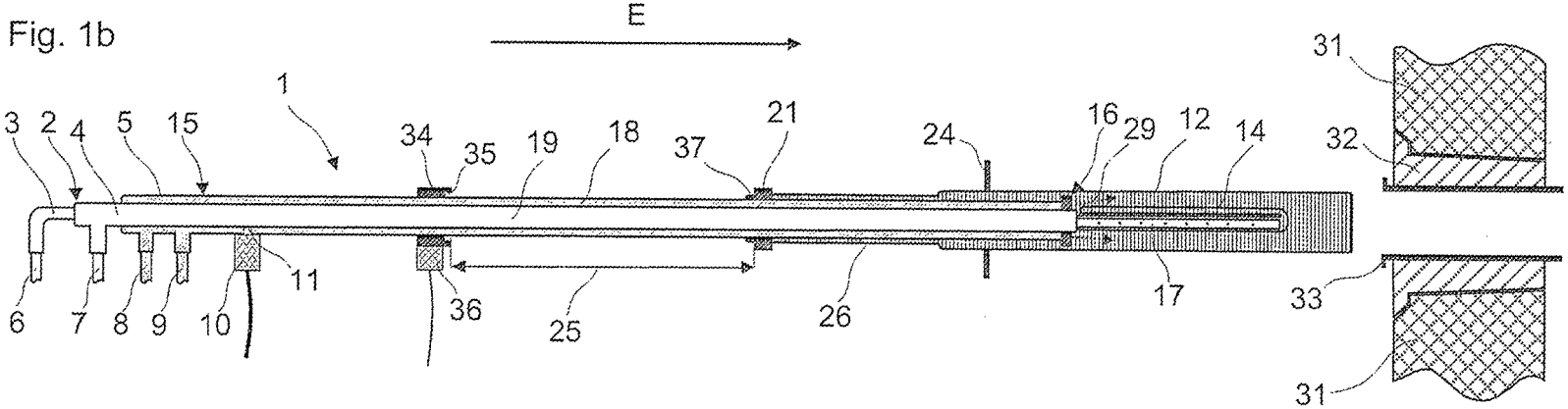

The embodiments of cleaning devices 1, 51 according to the invention and which are represented in the FIGS. 1*a*-1*d* and 2*a*-2*d* each include a coolable cleaning lance 2, 52. The cleaning lances 2, 52 each include a feed tube 4, 54 that is led from a grip-side end section 15, 65 to a cleaning-side end section 16, 66, is designed as an inner tube and through which the explosive mixture or its components are fed to the container envelope 14, 64. A first connection, into which a first feed conduit 7, 57 for the feed of a first component of the explosive mixture into the feed tube 4, 54 runs out is provided on the grip-side end section 15, 65. Moreover, an inlet connection piece 3, 53 arranged concentrically to the feed tube 4, 54 runs out into the feed tube 4, 54. A second component of the explosive mixture is fed into the feed tube 4, 54 via the inlet connection piece 3, 53. The inlet connection piece 3, 53 is connected to a second feed conduit 6, 56 for this.

The first component in the feed tube 4, 54 mixes with the second component into an explosive mixture. The first component, for example, can be oxygen or an oxygen-containing mixture. The second component can be a gaseous or liquid fuel, in particular a hydrocarbon compound.

An ignition device 10, 60 with a spark plug 11, 61 running out into the feed tube 4, 54 and being designed to electrically ignite the explosive mixture in the feed tube 4, 54 is attached on the cleaning lance 2, 52.

The feed tube 4, 54 is encased by an outer tube 5; 55*a*, 55*b*. An annular cooling channel 18, 68, in which a coolant is fed for cooling the feed tube 4, 54 is formed between the outer tube 5; 55*a*; 55*b* and the feed tube 4, 54. For this, a first and a second connection, onto which a first and a second feed conduit 8, 9; 58, 59 are connected for feeding a first and a second coolant, are provided on the grip-side end section 15, 65 of the cleaning lance 2, 52. The first coolant can be a cooling liquid such as water, and the second coolant can be a gas, such as air.

Also, only one coolant feed conduit can be envisaged for the feed of only one coolant, e.g. water. The coolant, e.g. a water/air mixture is thus led between the outer tube 5; 55*a*, 55*b* and the feed tube 4, 54. The coolant serves for the protection of the cleaning lance 2, 52 from too large a heating.

The coolant 29, 79 at the cleaning-side end section 16, 66 can exit out of the cooling channel 18, 68 via an axial exit opening. The coolant, which is led through the cleaning lance 2, 52 in this manner, can also cool the subsequently described protective tube 12, 62 or its receiving space, and the container envelope 14, 64, which is contained therein.

A lance cooling, which is designed in this manner, is preferably activated before the insertion of the cleaning lances 2, 52 into a hot receptacle to be cleaned. It typically remains switched on during the whole time, in which the cleaning lance 2 52 is subjected to heat.

The active cooling described above is however optional and is not an essential feature of the present invention.

The cleaning lance 2, 52 at the cleaning side end section 16, 166, which is opposite to the grip-side end section 15, 65, includes a container connection device 17, 67, onto which a container envelope 14, 64 can be attached in a manner such that this container envelope is filled by the explosive mixture flowing out of the feed tube 4, 54, amid expansion.

The container connection device 17, 67 is designed as a filling tube which, in the extension of the feed tube 4, 54, is attached onto this or is integrally formed with this. The container connection device 17, 67 can however also be designed differently, for example, as a connection piece.

The filling tube 17, 67 which here is designed with a smaller diameter than the feed tube 4, 54, along the longitudinal axis L comprises a plurality of exit opening 28, 70, through which the explosive mixture is let into the container envelope 14, 64. The filling tube 17, 67, which is also called a flute due to its plurality of exit openings 28, 70 on its periphery, permits an efficient and rapid filling of the container envelope 16, 64. The exit of the explosive mixture transversely to the longitudinal axis L moreover effects an optimal filling of the container envelope 14, 64.

The container envelope 14, 64 for this defines an expandable receiving space for the explosive mixture. The filling tube is either designed as a separate component which is attached on the feed tube 4, 54 in the extension of this, or is formed by an end of the feed tube 4, 54 itself.

The cleaning lance 2, 52 moreover includes a protective tube 12, 62. The protective tube 12, 62 is led concentrically over the feed tube 4, 54 and is displaceable relative to this along the longitudinal axis L of the cleaning lance 2, 52. A container envelope 14, 64, which is attached on the container connection device 17, 67, can be extended out and retracted into the protective tube 12, 62 on account of the mentioned displaceability.

According to the embodiment according to FIG. 1*a*-1*d*, the protective tube 12 is led concentrically over outer tube 5 and is displaceable relative to this and therefore also relative to the feed tube, along the longitudinal axis L of the cleaning lance 2.

The protective tube 12 is guided on the outer tube 5 via a suitable sliding guide and is displaceable relative to this in the longitudinal direction L. As a sliding guide, the protective tube 12 towards the grip-side end section 15 includes a guide tube section 26 that is guided over the outer tube 5. The outer tube 5 is slidingly guided in the guide tube section 26 along the longitudinal axis L. The outer tube 5 and the guide tube section 26 are sealed to one another via a gland seal 21.

An abutment element 13, which is to prevent the complete withdrawal of the outer tube 5 or of the feed tube 4 out of the protective tube 12, is attached on the cleaning-side end section 16 of the feed tube 4 or of the outer tube 5. This feature, however, is not essential and the limitation of the relative displacement between the protective tube 12 and the outer tube 5 or feed tube 4 can also be realised by a different limitation means.

The protective tube 12 can assume a first and second end position by way of the relative movement or relative displacement described above. The protective tube 12 in the first end position (FIG. 1*a*) is retracted towards the grip-side end section 15 and releases the filling tube 17 for attaching the container envelope 14 on the filling tube 17.

In a second end position (FIG. 1*b*), the protective tube 12 is extended in the direction of the cleaning-side end section 16 while forming a receiving space, and in this position envelops the filling tube and a not yet expanded container envelope 14, which is fastened on the filling tube 17. The flexible container envelope 14 is stowed in the protective tube 12 in a folded-together manner. The container envelope 14 is stowed in the receiving space of the protective tube 14 in a protected manner in this second end position.

Figures 1C, 1D:
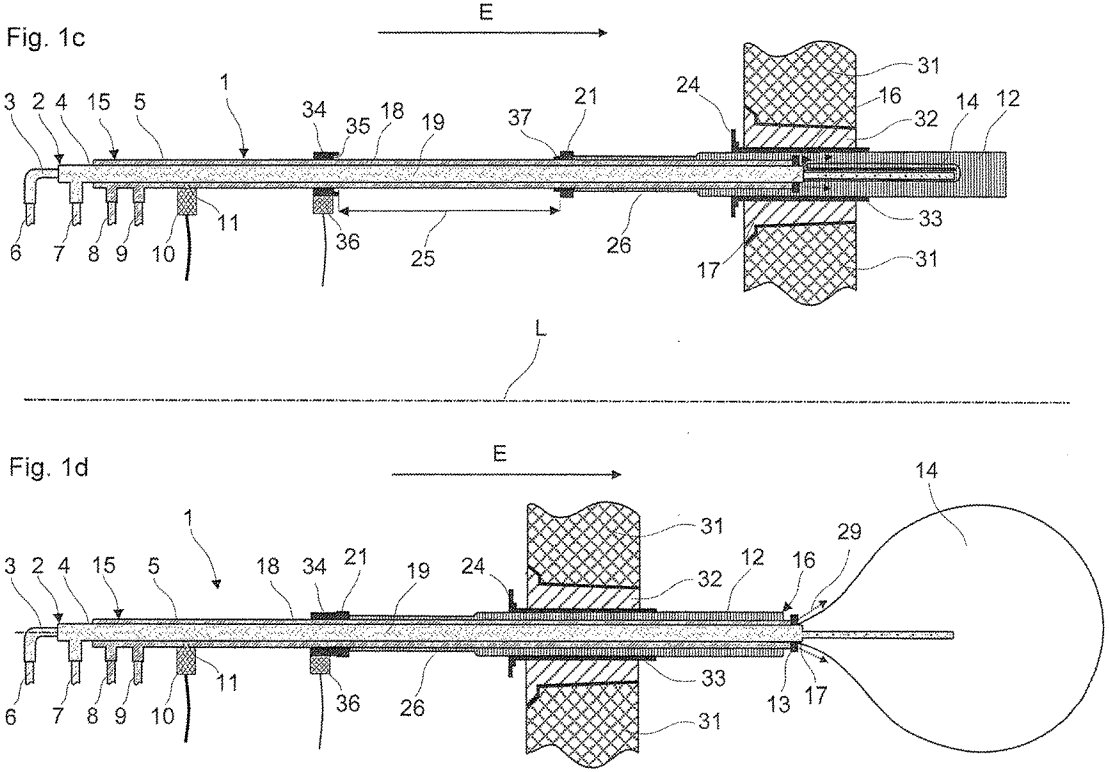
Figure 2A:
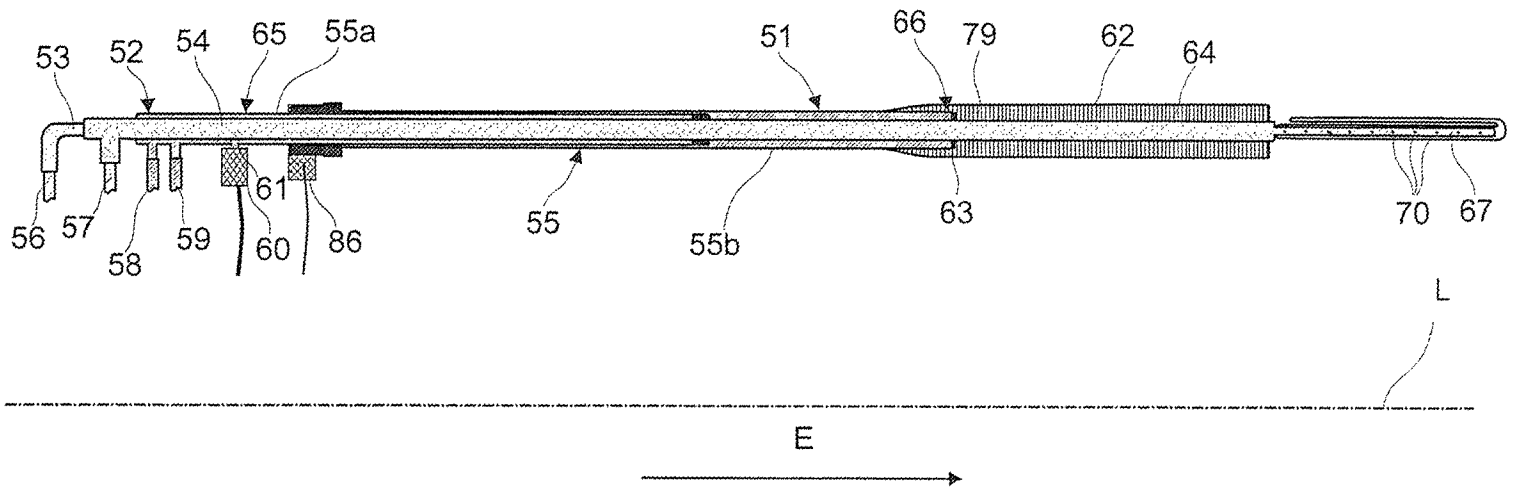
FIG. 2*a-d*: a second embodiment of a cleaning device according to the invention.
Figure 2B:
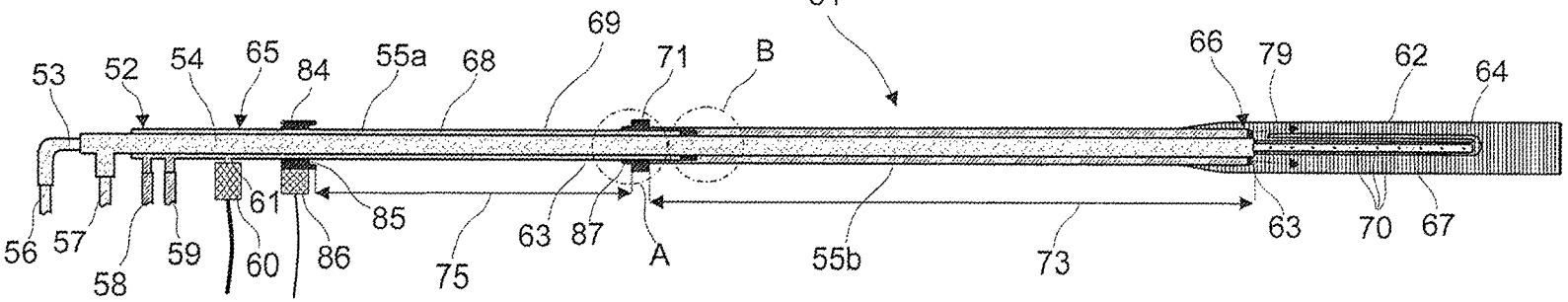
Figure 2C:
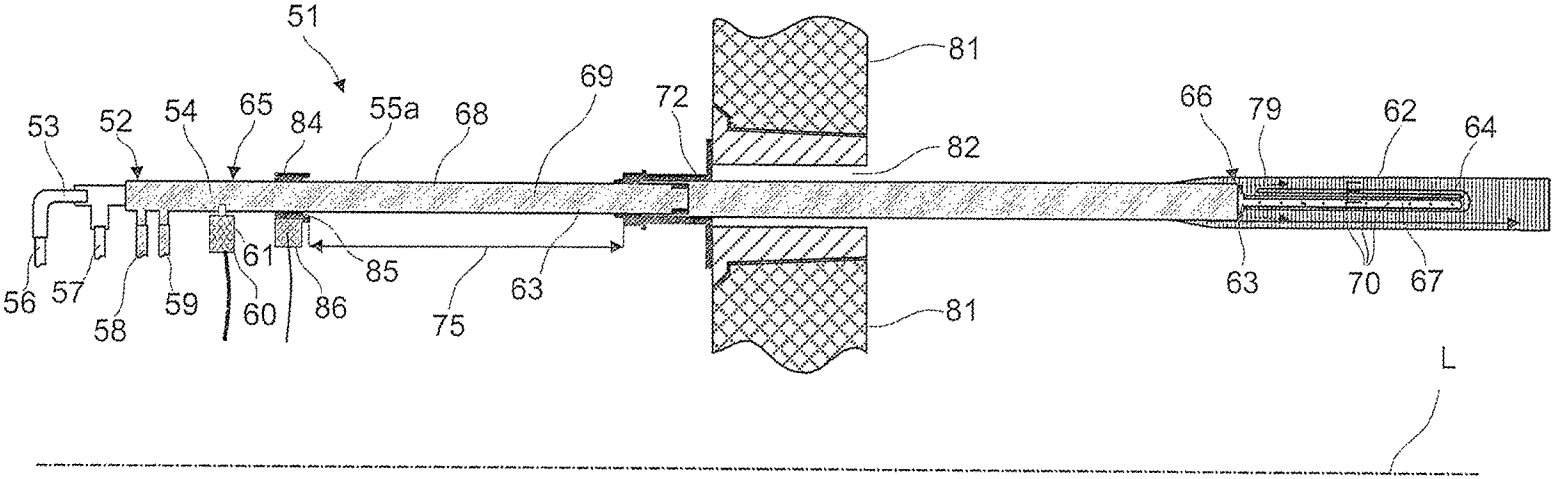
Figure 2D:
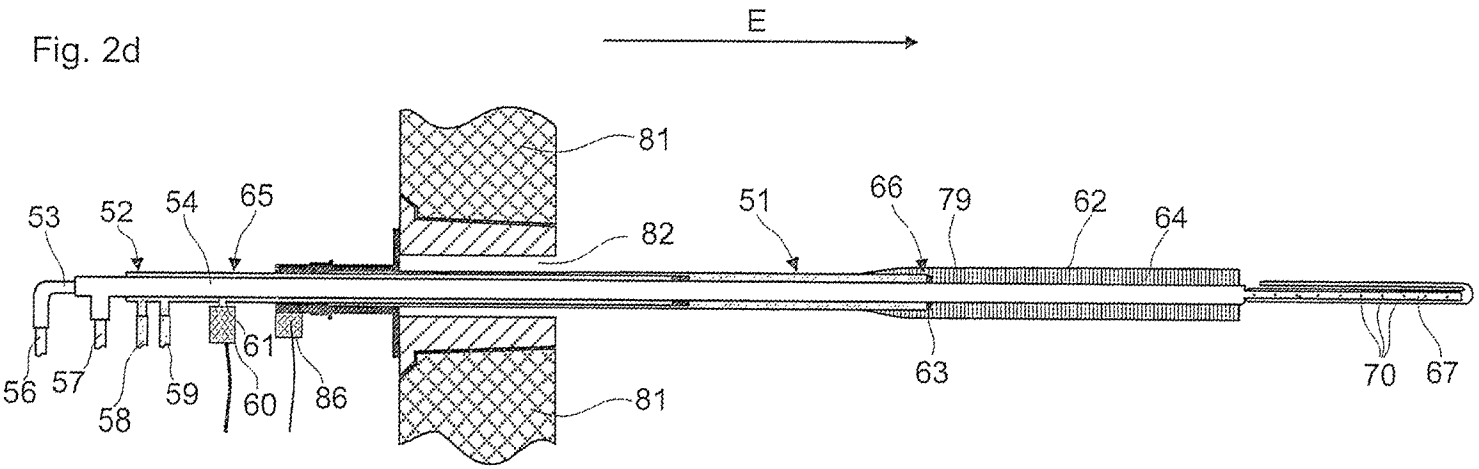

The cleaning lance 2 with this arrangement is inserted into the boiler space to be cleaned. For this, the cleaning lance 2 is led with the cleaning-side end section 16 through a boiler door 32 recessed in the boiler wall 31. An insertion component 33 with a guide tube section receiving and guiding the protective tube 12 is let into the boiler door 32 (FIG. 1*c*).

An insertion limitation collar 24 is attached on the protective tube 12 at the outer side, and this collar on account of its diameter, which is larger compared to the through-opening, abuts on the insertion component 33 on inserting the cleaning lance 2 into the boiler space and thus limits the insertion of the protective tube 12 into the boiler space.

The protective tube 12 remains in the second end position preferably until directly at the beginning of the expansion of the container envelope 14, so that the container envelope 14 is protected. The term "boiler" here is representative of many types of receptacles which are to be cleaned by way of the mentioned blasting technology.

The protective tube 12 is pushed back or retracted from its second end position into its first end position (FIG. 1*d*) for the purpose of filling the container envelope 14 with the explosive mixture and the expansion of the container envelope 14 amid the release of this container envelope.

The displacement from the second into the first end position is effected by way of the cleaning lance 2 and as a result of this the outer tube 5 together with the feed tube 4 being pushed further into the boiler space, after the protective tube 12 with its insertion limitation collar 24 already abuts on the adapter set (insertion component) 33 and is prevented from further insertion into the boiler space.

With this procedure, the protective tube 12 and the outer tube 5 slide along the longitudinal axis L relative to one another, so that the filling tube 17 at the cleaning-side end section 16 is moved out of the protective tube 12 in the insertion direction E and the container envelope 14 is pushed out of the protective tube 12.

The coolant exit on the cleaning-side end section simultaneously displaces together with the container envelope 14 and the filling tube 17. The container envelope 14 can continue to be cooled with coolant exiting at the end side at the coolant channel 18, even after the retraction of the protective tube 12 relative to the feed tube 4 or to the outer tube 5.

The protective tube 12 after completion of the insertion procedure assumes the first end position described above. The filling of the container envelope 14 with the explosive mixture (FIG. 1*d*) begins simultaneously or subsequently to this procedure. The explosive mixture after completion of the filling procedure is ignited for carrying out a cleaning procedure.

The cleaning lance 2 has a maximal ejection length 25, by which the outer tube 5 can be pushed into the guide tube section 26 and by which the filling tube 17 can be pushed together with the container envelope 14 out of the protective tube 12.

An adjustment ring 34 with an end switch 36 is arranged on the outer tube 5 towards the grip-side end section 15. This end switch forms a contact pick-up 35. An end-switch contact 37 is provided in the region of the gland seal 21, at which the outer tube 5 is inserted into the guide tube 26. The cleaning lance 2 between the end switch 36 and the end-switch contact 37 forms a tube section, whose length in the extended condition corresponds to the maximal ejection length 25. The adjustment ring 34 as a result forms an ejection limitation element.

The manner of functioning of the end switch 36 is analogous to that of the end switch described in the embodiment example according to FIGS. 5*a*-5*g* and 6*a*-*c*. The corresponding description is referred to. The described end switch 36 however is not an essential feature of this embodiment.

The cleaning lance 2 is pulled out of the boiler space opposite to the insertion direction E, subsequently to the explosion. The protective tube 12 thereby remains in its first end position. The cleaning lance 2 is now ready for being provided with a further container envelope 14. The procedure described above can be repeated.

The cleaning device 1 according to FIG. 1*a*-1*d* has the advantage that the container envelope 14 is stowed in a protected manner in the protective tube 12, until shortly before filling with the explosive mixture and the triggering of the explosion. The container envelope 14 can moreover be pushed out of the protective tube 12 from outside the boiler space.

Basically, it is also possible for the outer tube 5 to be pushed over the guide tube 26, in contrast to the present embodiment example according to FIG. 1*a*-1*d*. In other words, the guide tube 26 is led in the outer tube 5.

According to the embodiment according to FIGS. 2*a*-2*d*, the feed tube 54 is surrounded by an outer tube 55 which is designed in a two-part manner. The outer tube 55 includes a first outer tube section 55*a* that is connected to the grip-side end section 65. The first outer tube section 55*a* is moreover also connected to the feed tube 54. This means that the first outer tube section 55*a* and the feed tube 54 are not displaceable relative to one another along the longitudinal axis L.

A second outer tube section 55*b* runs out into the cleaning-side end section 66. The protective tube 62 is attached on the second outer tube section 55*b* towards the cleaning-side end section 66 and is fixedly connected to this second outer tube section.

The second outer tube section 55*b* is arranged concentrically to the first outer tube section 55*a* and has a larger diameter than the first outer tube section 55*a*. The first outer tube section 55*a* is inserted with an end section into the second outer tube section 55*b*, between the grip-side and the cleaning-side end section 65, 66. The first outer tube section 55*a* is now displaceably guided in the second outer tube section 55*b* along the longitudinal axis L. The first outer tube section 55*a* can therefore be telescopically extended and retracted with respect to the second outer tube section 55*b*, along the longitudinal axis L.

The cleaning lance 52 at the cleaning-side end section 66, which is opposite to the grip-side end section 65, includes a container connection device in the form of a filling tube 67, on which a flexible container envelope 64 is attached. The container envelope is attached in a manner such that this can be filled by the explosive mixture exiting from the feed tube 54 amid expansion. The container envelope 64 for this defines an expandable receiving space for the explosive mixture.

The protective tube 62 according to this second embodiment is led concentrically to the outer tube 55, i.e. to the second outer tube section 55*b*. In contrast to the embodiment variant according to FIG. 1*a*-*d*, the protective tube 62 is fixedly attached onto the outer tube 55, i.e. onto the second outer tube section 55*b*. The protective tube 62 extends along the longitudinal direction L or insertion direction E beyond the cleaning-side end section 66 of the second outer tube section 55*b*. It quasi connects in its extension.

The protective tube 62 according to this embodiment example is not displaceable along the longitudinal axis L with respect to the second outer tube section 55*b* of the outer tube, in contrast to the embodiment according to FIG. 1*a*-*d*. The protective tube 62 however is displaceable relative to the first outer tube section 55*a* and accordingly relative to the feed tube 54, along the longitudinal axis L, on account of the multi-part design of the outer tube 55 which is described above.

The second outer tube section 55*b* defines and insertion length 73, by which the protective tube 62 can be inserted with the container envelope 64 into the boiler space.

The first outer tube section 55*a* now in a first end position (see FIG. 2*a*) is pushed maximally into the second outer tube section 55*b*. The outer tube 55 in this position has the smallest longitudinal extension. The protective tube 62 in this end position is set back counter to the insertion direction E, with respect to the feed tube 54 or its filling tube 67. The filling tube 67 is accordingly released by the protective tube 62.

In this position, the filling tube 67 can be equipped with a container envelope 64 at the beginning of a new explosion cycle.

The first outer tube section 55*a* in a second end position (see FIG. 2*b*) is maximally extended with respect to the second outer tube section 55*b*. The outer tube 55 has the greatest longitudinal extension in this position. The protective tube 62 in this position is led completely over the feed tube 54 or over the filling tube 67 and forms a receiving space for the container envelope 64. The container envelope 64 is optimally protected to the outside from heat and combustion gases in this position. The first outer tube section 55*a*, for the purpose of insertion of the cleaning lance 52 into the boiler space and for the purpose of positioning the cleaning-side end section 66 of the cleaning lance 52 at the location to be cleaned, now assumes this second end position with respect to the second outer tube section 55*b*.

The cleaning lance 52 according to FIG. 2*a-d* is likewise inserted through a through-opening 82 in the boiler wall 81 into a boiler space (FIG. 2*c*), similarly to the first embodiment example according to FIG. 1*a-d*. An insertion component 72 with a guide tube section is attached at the outer side via the through-opening 82. The cleaning lance 52 is led in the guide tube section of the insertion component 72 via the second outer tube section 55*b*.

An insertion limitation element attached on the second outer tube section 55*b* limits the insertion of the second outer tube section 55*b* and thus of the protective tube 62 into the boiler space. In the present embodiment example, a gland seal 71, via which the first outer tube section 55*a* is inserted into the second outer tube section 55, simultaneously forms the insertion limitation element. However, a differently designed insertion limitation element can also be provided on the second outer tube section 55*b*.

On sliding the cleaning lance 52 into the boiler space, the insertion limitation element abuts on the insertion component 72 due to its diameter which is larger in comparison with the through-opening of the insertion component 72.

Thus, on inserting the cleaning lance 52 through the through-opening into the boiler space, the protective tube 62 is led through the through-opening into the boiler space so far until the gland seal 71 abuts at the outside on the boiler space on the insertion component 72. The second outer tube section 55*b* and thus the protective tube 62 of the cleaning lance 52 are thus inserted into the boiler space with the maximal insertion length 73 in this position.

The displacement from the second into the first end position is effected by way of the grip-side end section 65 of the cleaning lance 52 and, and as a result of this, the first outer tube section 55*a* and, with this, the inner tube 54, being pushed further into the boiler space, after the second outer tube section 55*b* and, with this, the protective tube 62, already abuts on the insertion component 72 via the insertion limitation element and is prevented from further insertion into the boiler space.

With this procedure, the first outer tube section 55*a* slides into the second outer tube section 55*b*, i.e. the first outer tube section 55*a* is inserted along the longitudinal axis L into the second outer tube section 55*b*. The two outer tube sections 55*a*, 55*b* as a result are telescopically pushed together along the longitudinal axis L or insertion direction E. With this procedure, the feed tube 54 is displaced in the insertion direction E with respect to the protective tube 62. The filling tube 67 is extended out of the protective tube 62 in the insertion direction E by way of this, and the container envelope 64 is pushed out of the protective tube 62 (see FIG. 2*d*).

The protective tube 62 after completion of the ejection procedure assumes the above described first end position. The filling of the container envelope 64 with the explosive mixture begins simultaneously or subsequently to this procedure (not shown). The explosive mixture is ignited for the purpose of carrying out a cleaning procedure, after completion of the filling procedure.

The annular cooling channel 68 between the feed tube 54 and the two outer tube sections 55*a*, 55*b* is designed in a continuous manner along the longitudinal axis L between the grip-side end section 65 and the cleaning-side end section 66, between the feed tube 54 and the two outer tube sections 55*a*, 55*b*. The two outer tube sections 55*a*, 55*b* of the outer tube and which can be sled into one another are sealed to one another via the mentioned gland seal 71, so that cooling fluid can no longer exit via their connection location.

An adjustment ring 84 with an end switch 86 is arranged on the first outer tube section 55*a*, towards the grip-side end section 65. This switch forms a contact pick-up 85. An end-switch contact 87 is provided in the region of the gland seal 71, on which the first outer tube section 55*a* is inserted into the second outer tube section 55*b*. The cleaning lance 52 in the extended condition and between the end switch 86 and the end-switch contact 87 forms a tube section, whose length corresponds to the maximal ejection length 75. The adjustment ring 85 forms an ejection limitation element as a result.

The manner of functioning of the end switch 86 is analogous to the end switch described in the embodiment example according to FIGS. 5*a-5g* and 6*a-6c*. The respective description is referred to. The described end switch 86 however is not an essential feature of this embodiment.

Basically, it is also possible for the first outer tube section 55*a* to be pushed over the second outer tube section 55*b*, in contrast to the present embodiment example according to FIG. 2*a-2d*. In other words, the second outer tube section 55*b* is guided in the first outer tube section 55*a*. This arrangement also permits a telescopic displacement of the two outer tube section 55*a*, 55*b* relative to one another.

Figure 4:
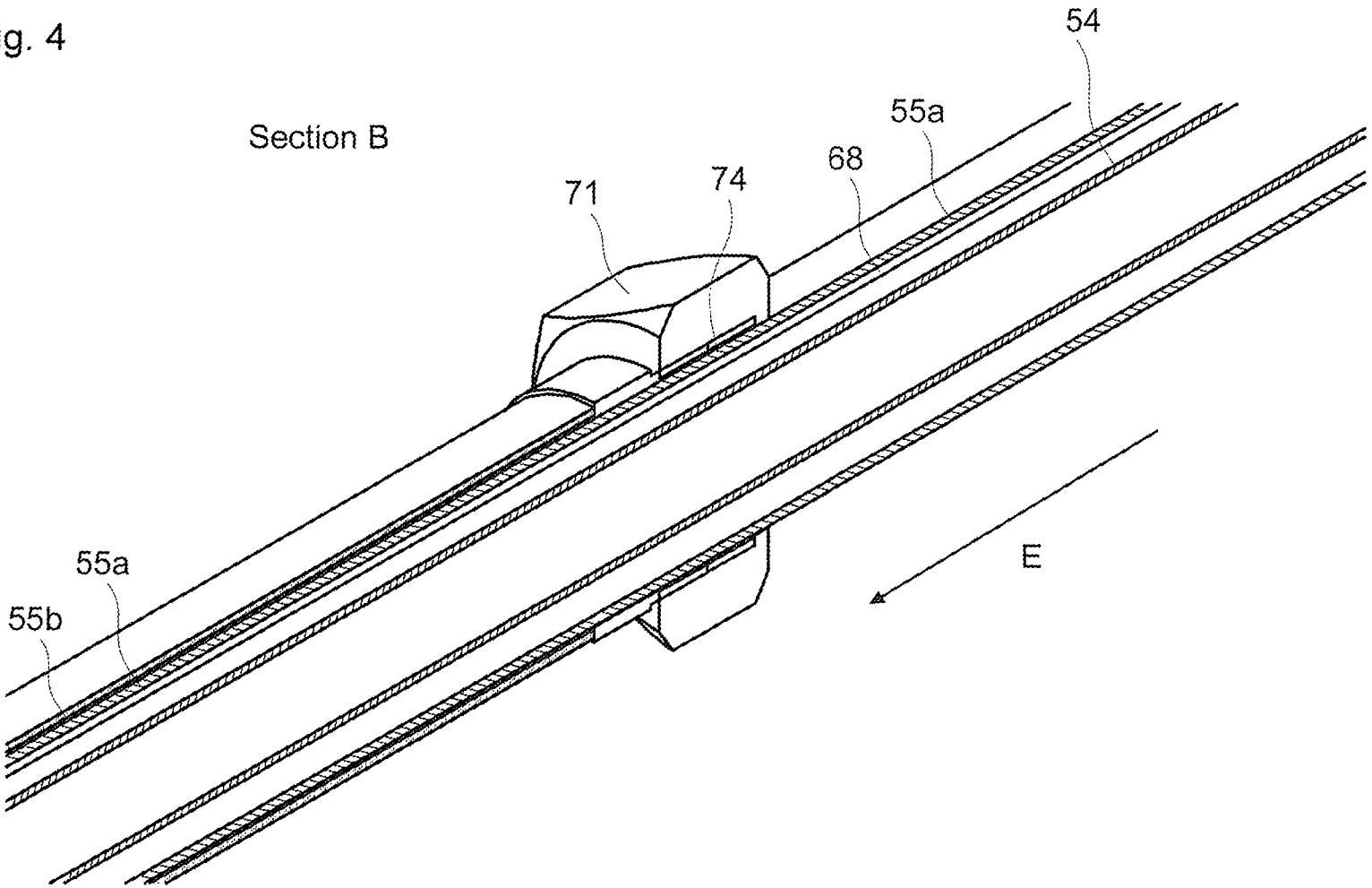
FIG. 4: an enlarged detail B according to FIG. 2*b;*
Figure 5A:
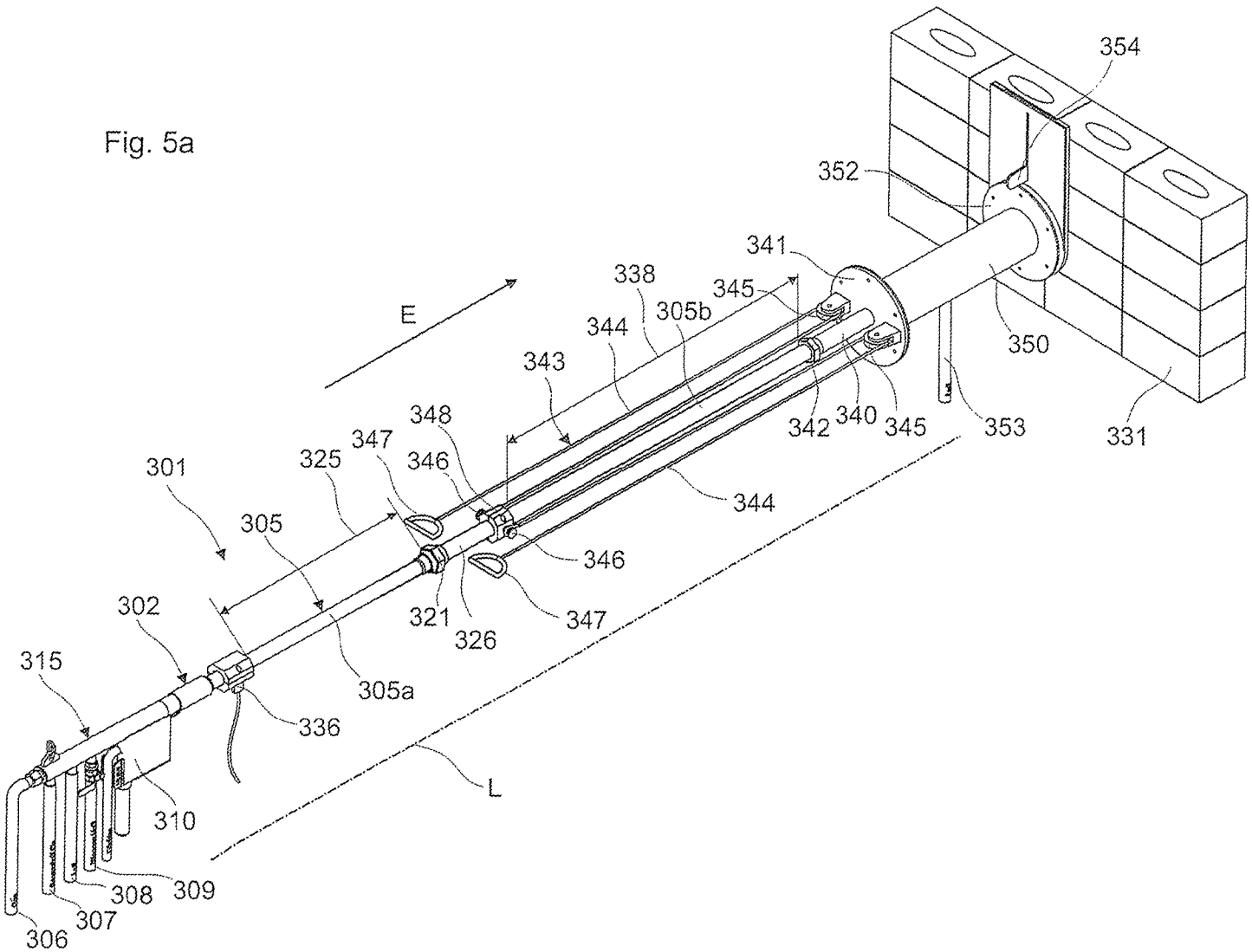
FIG. 5*a-g*: a third embodiment of a cleaning device according to the invention.
Figures 5B, 5C:
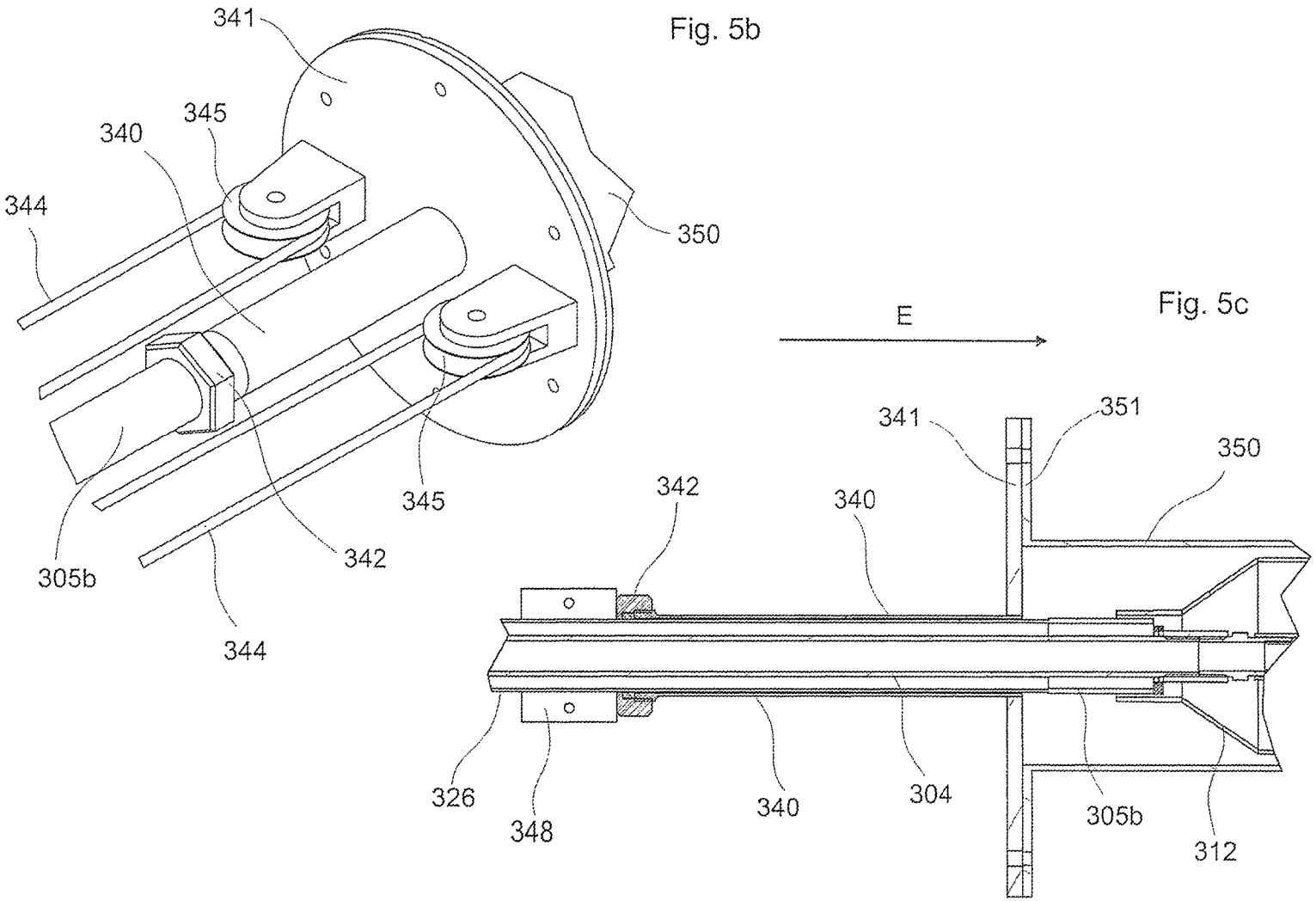
Figure 5F:
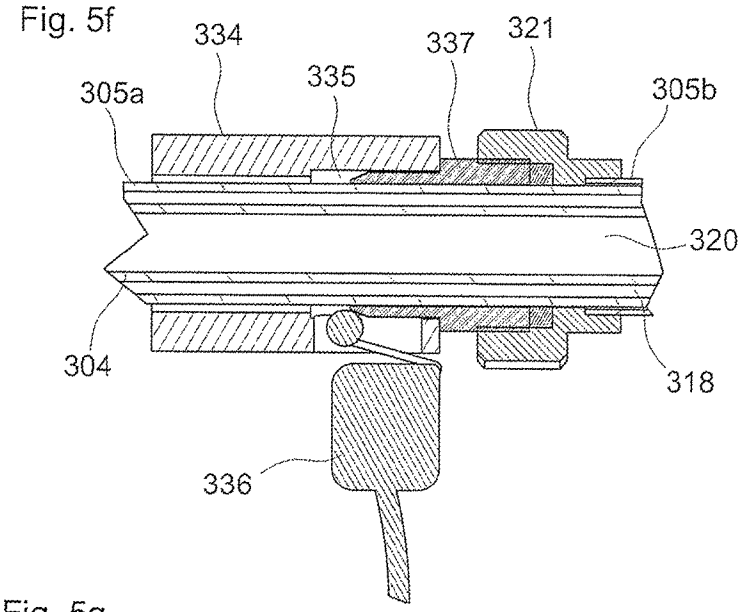
Figure 5G:
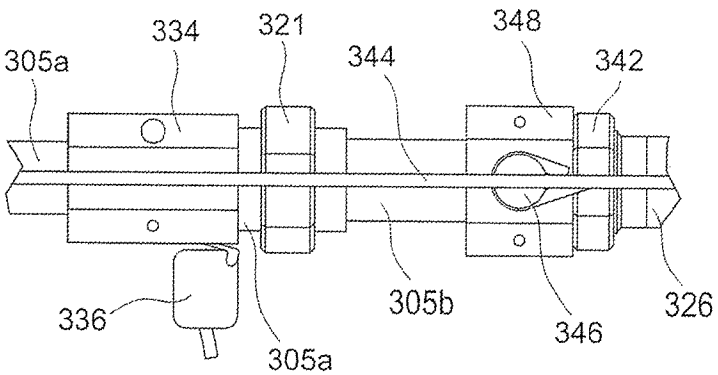
Figure 5D:
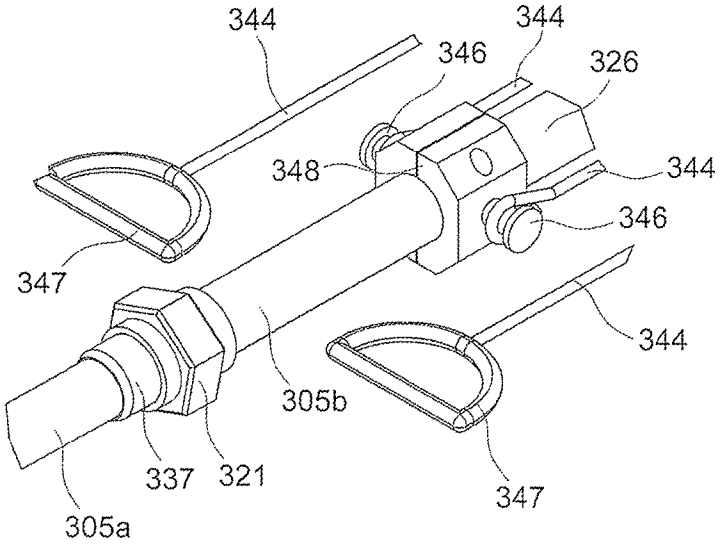
Figure 5E:
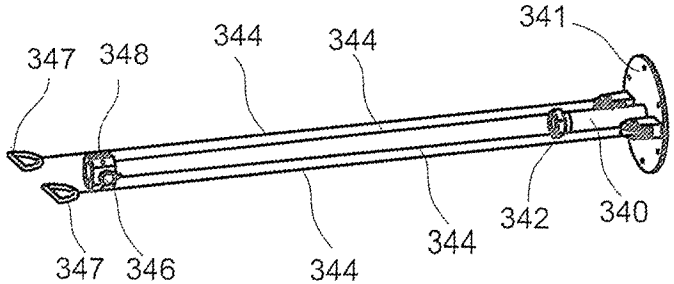

The gland seal 71, which seals the two outer tube sections 55*a*, 55*b* to one another, is described in more detail with regard to FIG. 4. In contrast to the embodiment according to FIG. 2*a-2d*, this however has no end-switch device. The gland seal 71 is fixedly connected to the second outer tube section 55*b*. The gland seal 71 comprises a sealing means 74 such as, for example, a sealing cord which seals the first outer tube section 55*a* with respect to the second outer tube section 55*b*.

Figure 3:
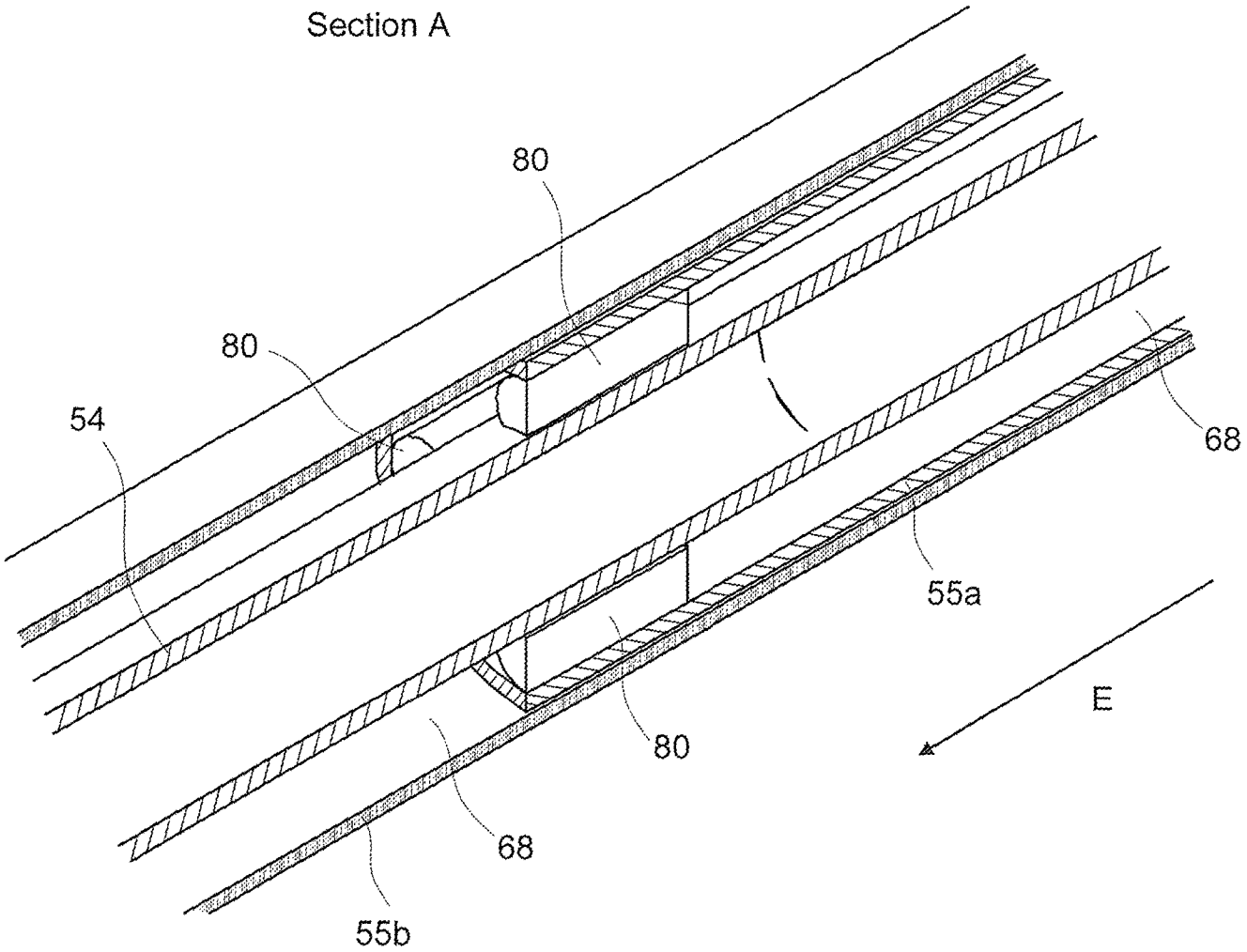
FIG. 3: an enlarged detail A according to FIG. 2*a;*

The first outer tube section 55*a* at its end section includes centering elements 80 which center the first outer tube section 55*a* in a coaxial position with respect to the inner-lying feed tube 54. The centering elements 80 are designed as a type of spacer arranged radially along the outer periphery of the feed tube 54. Passages for the coolant channel 68 are formed between the centering elements 80. In other words, the centering elements 80 do not fully interrupt the coolant channel 68 (FIG. 3).

The embodiment of a cleaning device 301 according to the invention, according to FIGS. 5*a-5g* and 6*a-6f* is particularly designed for cleaning combustion chambers, in which overpressure prevails. The cleaning device 301 includes a coolable cleaning lance 302. The cleaning lance 302 in each case comprises a feed tube 304 which is designed as an inner tube and which is led from a grip-side end section 315 to a cleaning-side end section 316. The feed tube 304 forms a closed channel 320, through which the explosive mixture or its end components are fed to the container envelope 314. A first connection, into which a first feed conduit 307 for the feed of a first component of the explosive mixture into the feed tube 304 runs out, is provided on the grip-side end section 315. An inlet connection piece, which is arranged concentrically to the feed pipe 304, runs out into the feed tube 304. A second component of the explosive mixture is fed into the feed tube 304 via the inlet connection piece. The inlet connection piece for this is connected to a second feed conduit 306.

The first component mixes with the second component into an explosive mixture, in the feed tube 304. The first component can, for example, be oxygen or an oxygen-containing gas. The second component can be a gaseous or liquid fuel, in particular a hydrocarbon compound.

An ignition device 310 with a spark plug which runs out into the feed tube 304 and is designed in order to electrically ignite the explosive mixture in the feed tube 304 is moreover attached on the cleaning lance 302.

The feed tube 304 is encased by an outer tube 305. An annular cooling channel 318, in which a coolant for cooling the feed tube 304 is fed, is formed between the outer tube 305 and the feed tube 304. For this, a first and second connection, to which a first and second feed conduit 308, 309 are connected for the feed of a first and a second coolant, is provided on the grip-side end section 315 of the cleaning lance 302. The first coolant can be a cooling liquid, such as water and the second coolant a gas such as, for example, air.

Also, only one coolant feed conduit can be provided for the feed of only one coolant, for example, water. The coolant, such as a water/air mixture, is thus fed between the outer tube 305 and the feed tube 304. The coolant serves for the protection of the cleaning lance 302 from heating up too much.

The coolant 339 can exit out of the cooling channel at the cleaning-side end section 316 via an axial exit opening. The coolant, which is led through the cleaning lance 302 in this manner, can also cool the subsequently described protective tube 312 or its receiving space and the container envelope 314, which is contained therein.

A lance cooling, which is fashioned in this manner, is preferably activated before the insertion of the cleaning lance 302 into a hot receptacle to be cleaned. It typically remains switched on during the whole time, in which the cleaning lance 302 is subjected to heat (see FIGS. 6*d*-6*f*).

The active cooling which is described above however is optional and is not an essential feature of the present invention.

The cleaning lance 302 at the cleaning-side end section 316 which lies opposite the grip-side end section 315 comprises a container connection device, onto which a container envelope 314 can be attached in a manner such that this envelope is inflated by the explosive mixture flowing out of the feed tube 304.

The container envelope 314 defines an expandable receiving space for the explosive mixture.

The cleaning lance 302 moreover includes a protective tube 312. The protective tube 312 is led concentrically over the feed tube 304. The feed tube 304 is displaceable relative to the protective tube 312 along the longitudinal axis L of the cleaning lance 302. A container envelope 314, which is attached on the container connection device, is extended out of the protective tube 312 or is retracted into this, by way of the mentioned displaceability.

The outer tube 305 is designed in a two-part manner and includes a first outer tube section 305*a* that is connected to the grip-side end section 315, as well as a second outer tube section 305*b* that is connected to the protective tube towards the cleaning-side end section 316. The first outer tube section 305*a* is guided with an end section in a second outer tube section 305*b*, so that the two tube sections 30*a*, 30*b* can be telescopically pushed together and pulled apart again.

The first outer tube section 305*a* in sections is slidingly guided along the longitudinal axis L in the second outer tube section 305*b*. The two outer tube sections 305*a*, 305*b* are sealed to one another via a gland seal 321, which is attached on the second outer tube section 305*b*.

An adjustment ring 334 with an end switch 336 is arranged on the first outer tube section 305*a*, towards the grip-side end section 315. This forms a contact receiver 335. An end-switch contact 337 is provided in the region of the gland seal 321, at which seal the first outer tube section 305*a* is inserted into the second outer tube section 305*b*. The cleaning lance 302 in the extended condition between the end switch a 336 and the end-switch contact 337 forms a tube section, whose length corresponds to the ejection length 325. The adjustment ring 334 as a result forms an ejection limitation element.

The length of the tube section between the gland seal 321 and the protective tube 312 and which is formed by the second outer tube section 305 depends on the required insertion length of the cleaning lance 302 into the combustion chamber. This length can be several meters, for example up to 10 meters.

The present cleaning device 301 moreover includes a lance insertion device. This includes an insertion component 340 with a guide tube section as well as with a fastening flange 341 for the direct and indirect fastening of the insertion tube 340 on the wall 331 of the combustion chamber. The insertion component 340 at its end facing the grip-side end section 315 includes a gland seal 342. The cleaning lance 302 is now inserted with its second outer tube section 305*b* into the insertion component 340 and is displaceable relative to this. The gland seal 342 seals the insertion component 340 and outer tube section 305*a* to one another. An adjustment ring 348 is attached on the second outer tube section 305*b* between the gland seal 321 on the outer tube section 305*b* and the gland seal 342 on the insertion component 340.

The lance insertion device moreover includes a pull cable 343. This consists of two cables 344 that are arranged on both sides of the outer tube section 305*b* and that are fastened with a first end on the adjustment ring 348 via cable fastenings 346. The two cables 244 towards the grip-side end section 315 are deflected via deflection rollers 345 of a deflection device that are fastened on the fastening flange 341 of the insertion component 340. Hand grips 347 are located at the second end of the cables 344. The adjustment ring 348 additionally serves an insertion limitation element.

In the present embodiment example, the cleaning device 301 is moreover a lock device. This includes a lock tube 350 which, at both face sides in each case, includes a fastening flange 351, 352. The lock tube 350 is connected to the fastening flange 341 of the insertion component 340 via the first fastening flange 352, for example, via screw connections. The lock tube 350 is fastened via the second fastening flange 352 on the wall 331 of the combustion chamber, i.e. via screw connections, and runs out into a through-opening in the wall 331. The lock tube 350 moreover includes blocking air feed means 353 for feeding blocking air into the lock tube 350.

The length of the lock tube 350 preferably corresponds at least to the length of the protective tube 312, since the lock tube 350 must be in the position of completely receiving the protective tube 312.

A slide arrangement 354 with a slide (slider) is provided between the through-opening and the lock tube 350 or its fastening flange 352. The through-opening can be closed by a slide by way of the slide arrangement 354.

The lock device as well as the pull cable 343 are not essential features of the device. The insertion component 340 can thus also be arranged directly on the boiler wall 331 via the through-opening.

The operation of the cleaning device 301 is described hereinafter.

Figures 6A, 6B:
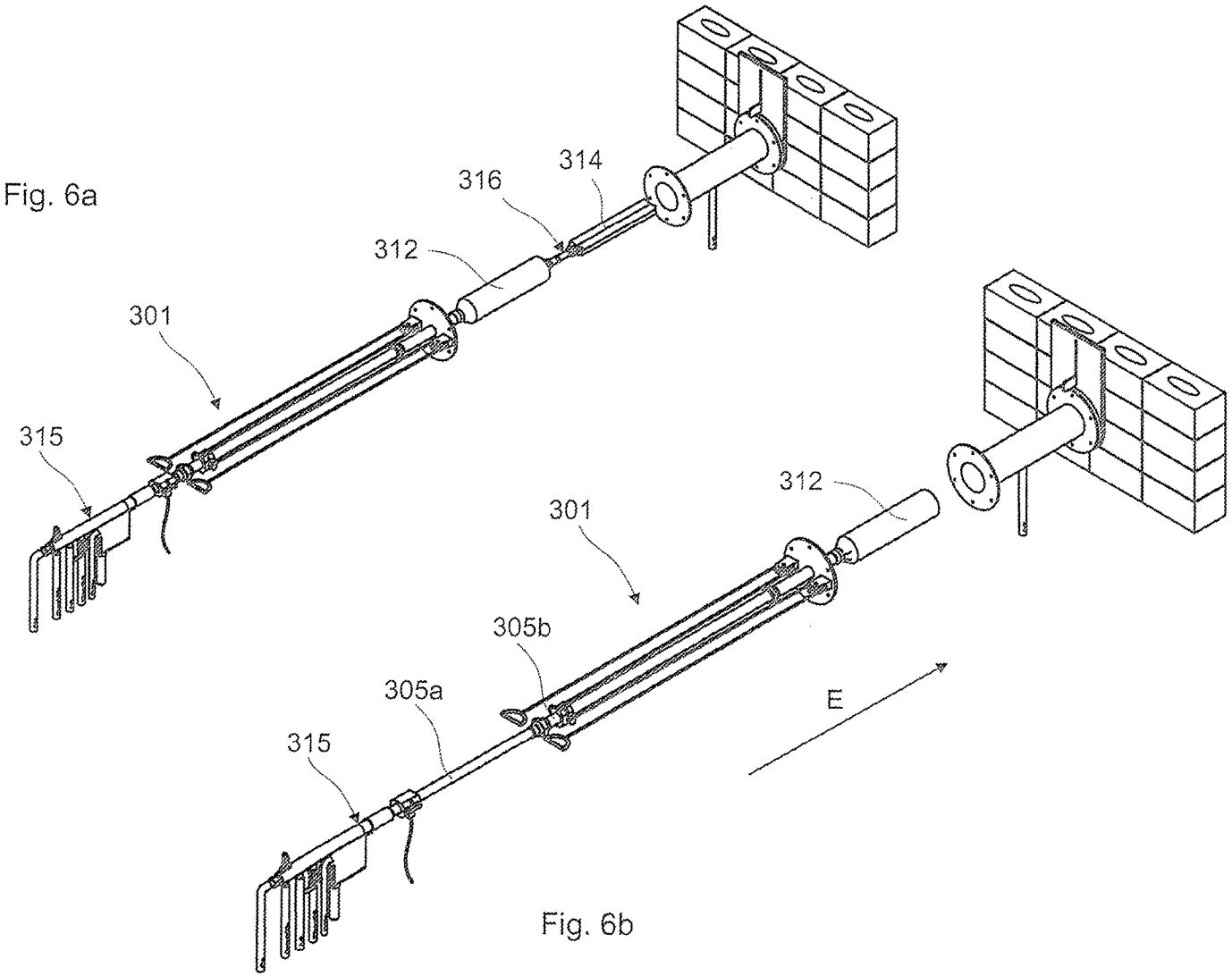
FIG. 6*a-f*: a cleaning device according to FIG. 5, in different insertion positions
Figures 6C, 6D:
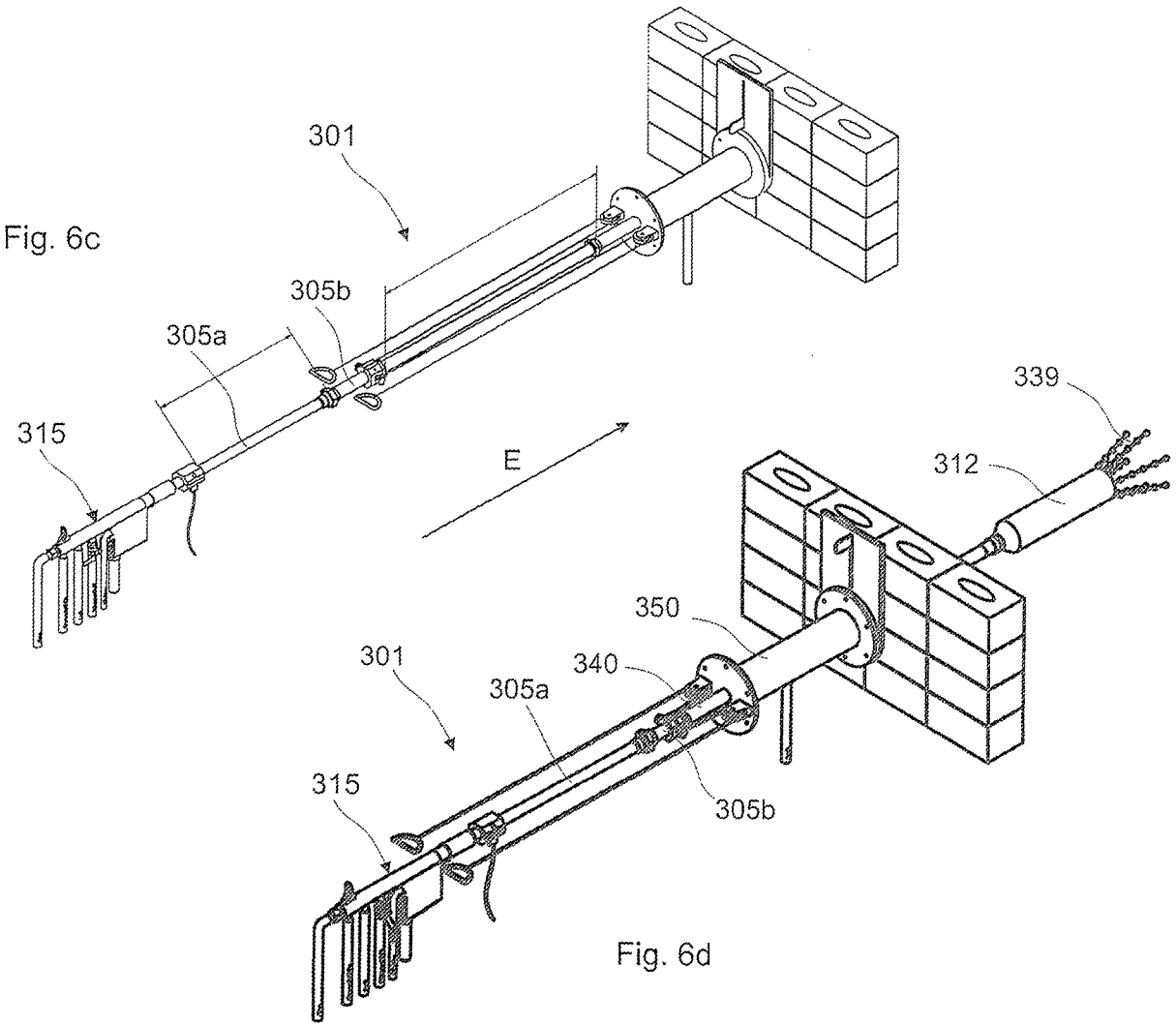

The two outer tube sections 305*a*, 305*b* are pushed together in a telescopic manner at the beginning of the method, so that the container connection device is extended in the direction of the opening of the protective tube 312 or completely out of the protective tube 312, such that a container envelope 314 can be fastened thereon (see FIG. 6*a*).

The container connection device together with the container envelope 314, which is fastened thereon, is retracted into the protective tube 312 by way of pulling apart the two outer tube sections 305*a*, 305*b* in a telescopic manner, so that the container envelope 314 is stowed in the protective tube 312 (see FIG. 6*b*).

The cleaning lance 302 with the protective tube 312 is inserted into the lock tube 350. The cleaning lance 302 is subsequently fastened on the lock tube 350. For this, the fastening flange 341 of the insertion tube 340 is connected to the fastening flange 351 of the lock tube 350 (see FIG. 6*c*).

The through-opening is closed by the slide of the slide device 345 during this procedure. Atmospheric pressure from outside the combustion space prevails in the lock tube 350.

The lock tube 350 is sealed to the environment outside the combustion space by way of the connection of the two ring flanges 341, 351. Blocking air is then let into the lock tube 350, and this is to create a pressure adaptation to the overpressure in the combustion chamber.

In a further step, the through-opening is opened by way of actuating the slide device 354. The cleaning lance 302 with the protective tube 312 and the container envelope 314 are pushed through the through-opening into the combustion chamber by way of pulling on the hand grips 347. With this procedure, the adjustment ring 349, which is attached in a displaceably fixed manner on the second outer tube section 305*b* and on which the cables 344 are fastened, is displaced in the direction of the lock tube 350, and accordingly the outer tube section 305*b* is pushed into the insertion component 340 and the lock tube 350. The protective tube 350. which is attached onto the outer tube section 305*b*. is accordingly pushed together with the container envelope 314 into the combustion chamber (see FIG. 6*d*).

The insertion length 338 is defined by the length of the tube section between the adjustment ring 348 on the second outer tube sections 305*b* and the gland seal 342 on the insertion component 340. The protective tube 312 can only be inserted so far into the combustion space, until the adjustment ring 348 abuts on the gland seal 342. The insertion length 388 corresponds to that length, by which the cleaning lance 302 with the protective tube 312 can be inserted into the combustion chamber.

At the latest, the cooling 339 is activated with the insertion of the protective tube 312 into the combustion chamber and this cooling ensures the cooling of the protective tube 312 and the container envelope 314, which is stowed therein.

Figures 6E, 6F:
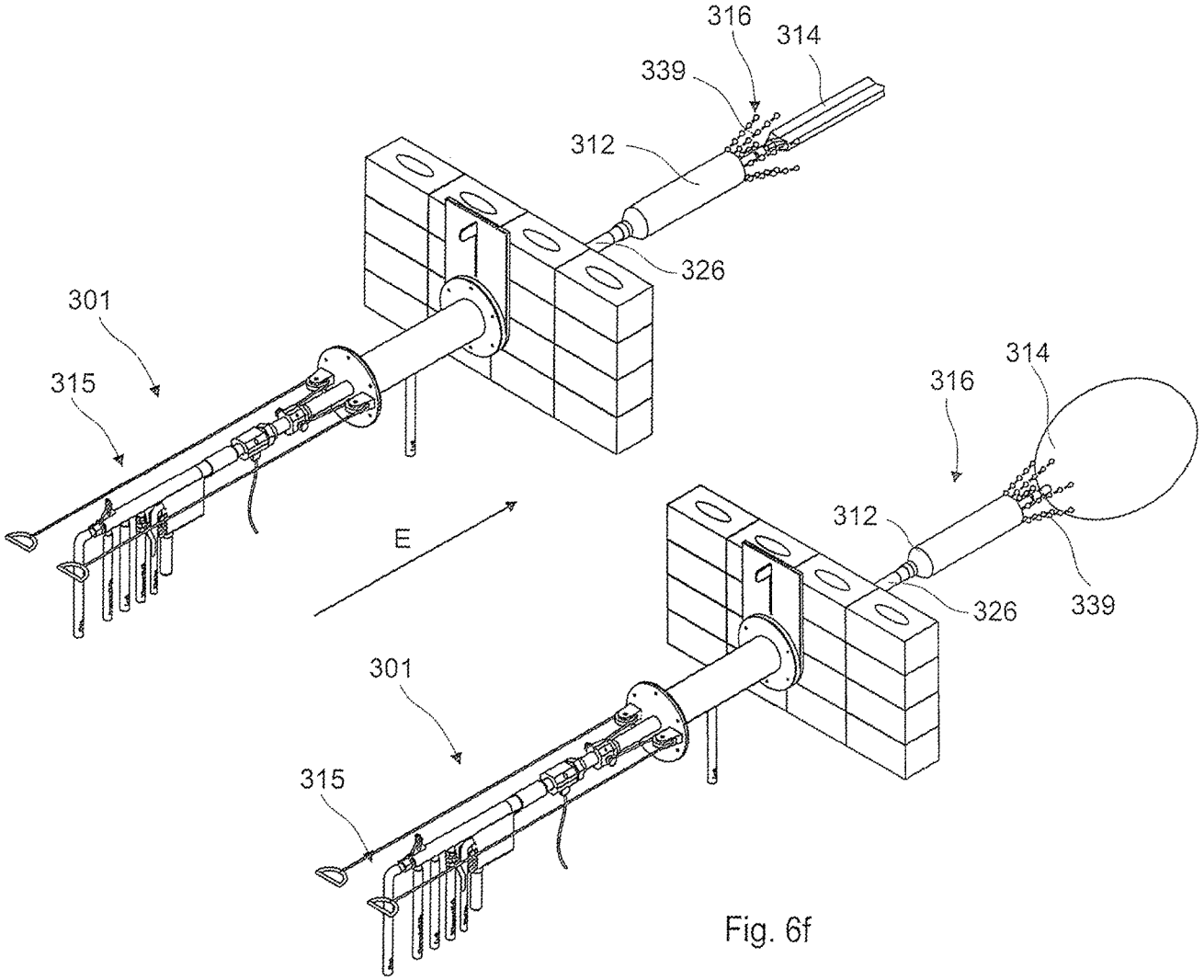

The ejection of the container envelope 314, which hitherto was still stored in the protective tube 312, is effected as soon as the desired or the maximal possible insertion length 338 of the protective tube 312 into the combustion chamber has been reached (FIG. 6*e*).

This is effected by way of the adjustment ring 334 fixedly seated on the first outer tube section 305*a* and with the end switch 336, together with the first outer tube section 305*a* being pushed in the direction of the gland seal 321 of the second outer tube section 305*b*. The first outer tube section 305*a* is thereby telescopically inserted into the second outer tube section 305*b*. The inner tube 304 is accordingly also displaced with respect to the second outer tube section 305*b* and the protective tube 312, since the inner tube 304 is coupled to the first outer tube section 305*a*. The container envelope, which is connected to the inner tube 304 in a direct or indirect manner, is pushed out of the protective tube 312 by way of this.

If the adjustment ring 334 with the end switch 336 reaches the gland seal 321 when telescopically inserting the two outer tube sections 305*a*, 305*b* into one another, then the end-switch contact 337, which is arranged on this, moves into the end-switch contact pick-up 335 on the adjustment ring 334. A contact is created by way of this, and this contact generates a release signal. Not until this release signal is generated and is, for example, processed by the control, can the container envelope 314 be filled with the explosive gas mixture and the explosive mixture ignited (see FIG. 6*f*).

In this manner, one prevents the container envelope 314 from being filled with the explosive mixture before the ejection of this envelope out of the protective tube 312 and this gas from being ignited. The described end switch 336, however, is not an essential feature of this embodiment.

The gas mixture is ignited and made to explode as soon as the container envelope 314 is completely filled with the explosive gas mixture.

The protective tube 312 after the explosion has been effected can be pulled out of the combustion space again, back into the lock tube 350. The through-opening is closed again via the slide device 354. The overpressure in the lock tube 350 is accordingly relieved either via the blocking air feed means 353 or by way of opening the lock tube 350 on releasing the connection between the two fastening flanges 341, 351.

The embodiment according to FIG. 5*a*-5*g* and 6*a*-6*f* is particularly suitable for cleaning combustion chambers with overpressure. Hot combustion gases are prevented from getting to the outside through the through-opening due to the overpressure when inserting the cleaning lance into the combustion chamber, thanks to this cleaning device.

The invention claimed is:

1. A cleaning device for removing deposits in receptacles by way of blasting technology, comprising a cleaning lance with a grip-side and with a cleaning-side end section, wherein the cleaning lance comprises a feed channel with a container connection device that is arranged on the cleaning-side end section and on which a flexible container envelope forming a receiving space can be attached, as well as a protective tube with a receiving space for a container envelope for the propose of shielding the container envelope to the outside, wherein the feed channel is displaceably arranged along the longitudinal axis of the cleaning lance relative to the protective tube, from a first position, in which a container envelope attached on the container connection device is shielded with respect to the environment by the protective tube, into a second position, in which the container envelope projects out of the shielding through the protective tube.

2. The cleaning device according to claim 1, wherein the protective tube or a guide tube which is connected to the protective tube is designed as a sliding tube, which is displaceably guided on the cleaning lance along the longitudinal axis relative to the feed channel.

3. The cleaning device according to claim 1, wherein the feed channel is enveloped by an outer tube, wherein preferably an annular cooling channel is formed between the feed channel and the outer tube.

4. The cleaning device according to claim 1, wherein the feed channel is a tubular conduit body, in particular a feed tube.

5. The cleaning device according to claim 3, wherein the protective tube and/or the guide tube which is connected to this is displaceably guided along the longitudinal axis on the outer tube.

6. The cleaning device according to claim 1, wherein the outer tube is designed in a multi-part manner of at least one first and a second outer tube section, and the protective tube is connected to the second outer tube section, wherein the at least two outer tube sections are slidingly telescopically displaceable in one another in the longitudinal direction.

7. The cleaning device according to claim 6, wherein the first outer tube section is pushed with an end section into the second outer tube section, or the second outer tube section is pushed with an end section into the first outer tube section.

8. The cleaning device according to claim 1, wherein the cleaning device comprises an actuator via which the feed channel can be displaced along the longitudinal axis L relative to the protective tube or guide tube, in a manual or automated manner.

9. The cleaning device according to claim 1, wherein the cleaning device comprises an insertion component that can be fastened directly or indirectly on the wall of the receptacle and is with a guide tube section, through which the cleaning lance can be displaceably guided.

10. The cleaning device according to claim 1, wherein the feed channel runs from the grip-side to the cleaning-side end section, and the cleaning lance on the grip-side end section comprises a device for feeding the explosive mixture or components thereof to the feed channel.

11. The cleaning device according to claim 3, wherein the outer tube is centred with respect to the feed tube via centring elements, which are arranged radially along the outer periphery of the feed tube.

12. The cleaning device according to claim 1, wherein an insertion limitation element that serves as an insertion limitation for the protective tube on inserting the cleaning lance into a receptacle is arranged on the protective tube, on the guide tube or on an outer tube section.

13. The cleaning device according to claim 9, wherein the cleaning device comprises an insertion component in the form of an installation piece with a guide tube section for installation into the wall or an opening in the wall, of a receptacle to be cleaned, in which section the cleaning lance can be displaceably guided.

14. The cleaning device according to claim 1, wherein the cleaning lance comprises an end-switch device that activates a control signal with the in particular telescopic sliding-together of two tube bodies on reach a certain degree of displacement or upon reaching a defined end position.

15. A method for removing deposits in receptacles by way of blasting technology amid the use of a cleaning device according to claim 1, comprising the steps of:

attaching a container envelope on the container connection device at the cleaning-side end section of the cleaning lance;

displacing the protective tube relative to the feed channel while receiving the container envelope in the receiving space of the protective tube;

inserting the cleaning lance with a lance cleaning-side end section into the interior of a receptacle to be cleaned;

displacing the protective tube relative to the feed channel amid a release of the container envelope;

filling the container envelope with an explosive mixture or its components;

igniting the explosive mixture in the container envelope.

* * * * *